US011686501B2

(12) United States Patent
Chothave et al.

(10) Patent No.: US 11,686,501 B2
(45) Date of Patent: Jun. 27, 2023

(54) SIDE PANEL ASSEMBLY FOR ROOF TOP UNITS

(71) Applicant: Johnson Controls Technology Company, Auburn Hills, MI (US)

(72) Inventors: Amit Chothave, Pune (IN); Sriram Ramanujam, Chennai (IN); Karan Garg, Jagadhri (IN); Praveen Gotakhindi, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 136 days.

(21) Appl. No.: 17/236,802

(22) Filed: Apr. 21, 2021

(65) Prior Publication Data

US 2021/0325082 A1 Oct. 21, 2021

(51) Int. Cl.

| | |
|---|---|
| ***F24F 13/32*** | (2006.01) |
| ***F24F 13/20*** | (2006.01) |
| ***F24F 13/28*** | (2006.01) |
| ***F24F 13/30*** | (2006.01) |

(52) U.S. Cl.

CPC ..... *F24F 13/32* (2013.01); *F24F 13/20* (2013.01); *F24F 13/28* (2013.01); *F24F 13/30* (2013.01); *F24F 2221/16* (2013.01)

(58) Field of Classification Search

CPC .. F24F 13/32; F24F 13/20; F24F 13/28; F24F 13/30; F24F 2221/16

See application file for complete search history.

(56) References Cited

U.S. PATENT DOCUMENTS

| | | | | |
|---|---|---|---|---|
| 6,497,256 | B1 * | 12/2002 | Adams | F24F 13/20 138/158 |
| 2003/0011289 | A1 * | 1/2003 | Adams | F24F 13/20 312/265.1 |
| 2004/0063398 | A1 * | 4/2004 | Beser | F24F 13/20 454/254 |
| 2007/0290586 | A1 * | 12/2007 | Rosete | F24F 13/20 29/890.035 |
| 2015/0111488 | A1 * | 4/2015 | Son | F24F 13/20 454/329 |
| 2018/0080677 | A1 * | 3/2018 | Carton | F24F 13/20 |
| 2018/0080678 | A1 * | 3/2018 | Carton | F24F 13/06 |

FOREIGN PATENT DOCUMENTS

WO WO-2017149341 A1 * 9/2017 ..... E06B 1/12

* cited by examiner

*Primary Examiner* — Emmanuel E Duke
(74) *Attorney, Agent, or Firm* — Fletcher Yoder, P.C.

(57) ABSTRACT

A wall panel assembly for a heating, ventilation, and air conditioning (HVAC) unit includes a panel having a main body, where the panel is configured to be fastened to a frame of the HVAC unit, and a plurality of stiffeners attached to the panel along a perimeter of the main body. A stiffener of the plurality of stiffeners includes a flat portion and a raised portion offset from the flat portion, where the raised portion is configured to sealingly engage with a component disposed within the HVAC unit.

20 Claims, 9 Drawing Sheets

SIDE PANEL ASSEMBLY FOR ROOF TOP UNITS

CROSS REFERENCE TO RELATED APPLICATION

This application claims priority from and the benefit of India Provisional Application Serial No. 202011017103, entitled "A SIDE PANEL ASSEMBLY FOR ROOF TOP UNITS," filed Apr. 21, 2020, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which are fluidly coupled to one another via conduits of a refrigerant loop. A compressor may be used to circulate a refrigerant through the refrigerant loop to enable the transfer of thermal energy between components of the HVAC system (e.g., the condenser, the evaporator), the environment, and an air flow conditioned by the HVAC system for supply to a conditioned space (e.g., within a building).

The vapor compression system may be disposed within a housing of the HVAC system that is configured to receive an air flow, such as an outdoor air flow and a return air flow received from the conditioned space, to be conditioned by the HVAC system. The air flow may be directed through the housing to exchange thermal energy with the refrigerant circulated by the vapor compression system. To this end, the housing of the HVAC system may include wall panels that define a flow path of the air flow directed through the housing. In some applications, the wall panels may have a single wall construction. Such wall panels may form spaces or voids between the wall panels and components disposed within the housing, such a filter or heat exchanger. Unfortunately, the air flow may flow through the spaces or voids instead of through or across the components disposed within the housing, which may result in undesired (e.g., inefficient) operation of the HVAC system. In some systems, wall panels may have a double wall construction to reduce formation of spaces or voids between the wall panel and components within the housing. Unfortunately, wall panels having a double wall construction may be expensive, thereby leading to an increase in overall costs associated with manufacture of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a wall panel assembly for a heating, ventilation, and air conditioning (HVAC) unit. The wall panel assembly includes a panel having a main body, where the panel is configured to be fastened to a frame of the HVAC unit, and a plurality of stiffeners attached to the panel along a perimeter of the main body. A stiffener of the plurality of stiffeners includes a flat portion and a raised portion offset from the flat portion, where the raised portion is configured to sealingly engage with a component disposed within the HVAC unit.

The present disclosure also relates to a heating, ventilation, and air conditioning (HVAC) unit including a housing frame, a rack disposed within the housing frame, where the rack is configured to support conditioning equipment of the HVAC unit, and a wall panel assembly coupled to the housing frame. The wall panel assembly includes a single wall panel having a main body and includes a plurality of stiffeners coupled to the single wall panel and extending along a perimeter of the main body. The plurality of stiffeners includes an extended stiffener having a flat portion and a raised portion offset from the flat portion, where the raised portion is configured to create a sealing interface with the rack.

The present disclosure further relates to a wall panel assembly of a heating, ventilation, and air conditioning (HVAC) unit housing. The wall panel assembly includes a panel having a main body, where the panel is formed from a single sheet of material, and a plurality of stiffeners coupled to the panel at corresponding edges of the main body. Each stiffener of the plurality of stiffeners includes a flat portion extending along the main body, and a stiffener of the plurality of stiffeners includes a raised portion extending and offset from the flat portion of the stiffener, where the raised portion is configured to abut and sealingly engage with a component disposed within the HVAC unit housing.

BRIEF DESCRIPTION OF THE DRAWINGS

Various aspects of this disclosure may be better understood upon reading the following detailed description and upon reference to the drawings in which.

DETAILED DESCRIPTION

Figure 1:
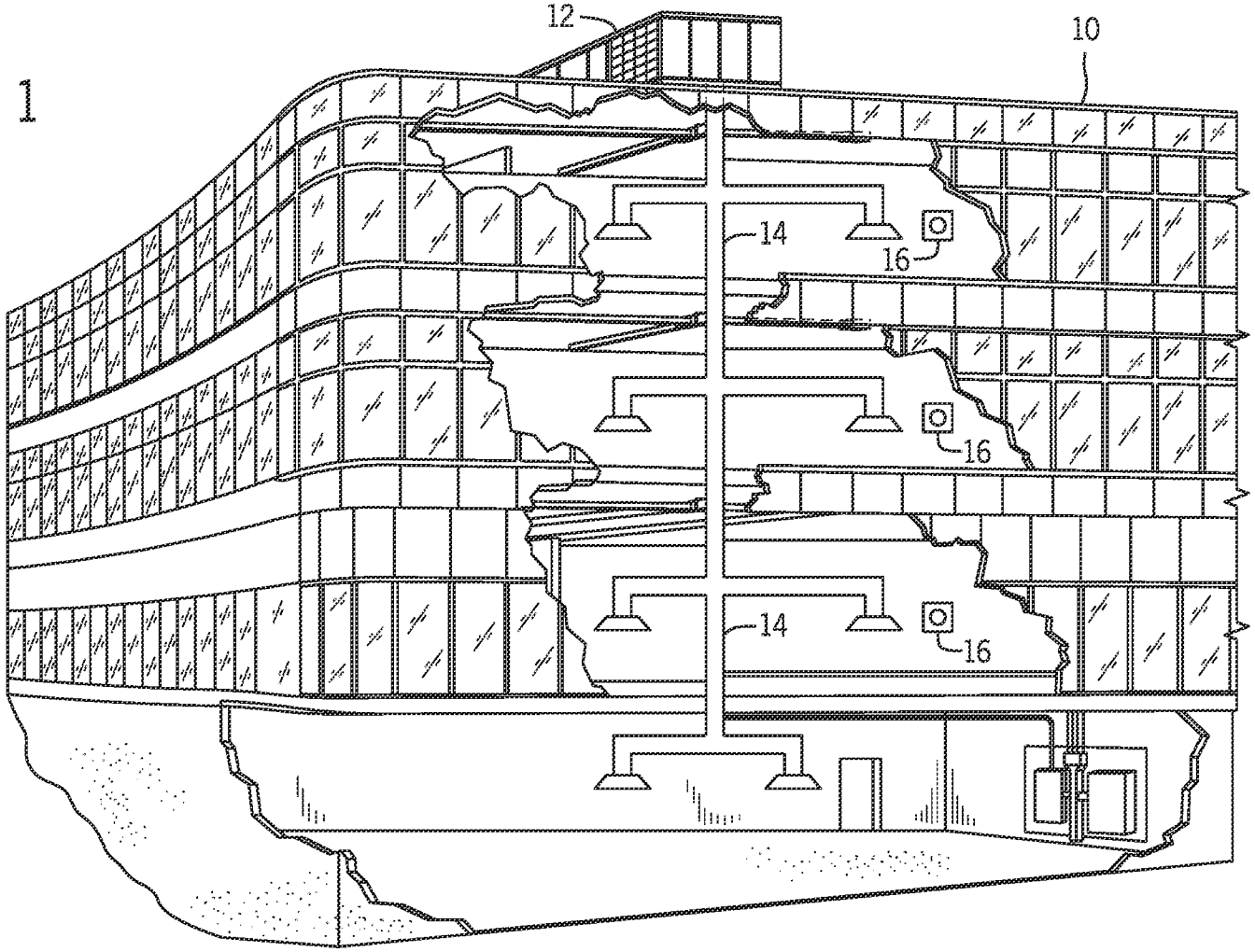
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a conditioned space within a building, home, or other suitable structure. For example, the HVAC system may include a vapor compression system that transfers thermal energy between a working fluid, such as a refrigerant, and a fluid to be conditioned, such as air. The vapor compression system includes a condenser and an evaporator that are fluidly coupled to one another via one or more conduits of a refrigerant loop or circuit. A compressor may be used to circulate the refrigerant through the conduits and other components of the refrigerant loop (e.g., an expansion device) and, thus, enable the transfer of thermal energy between components of the refrigerant loop (e.g., between the condenser and the evaporator) and one or more thermal loads (e.g., an environmental air flow, a return air flow, a supply air flow, etc.). The HVAC system may include additional components to enable conditioning of the fluid (e.g., air), such as filters configured to remove particles (e.g., dust, debris, etc.) within the fluid, louvers configured to control a quantity of the fluid directed through the HVAC system, and so forth. As used herein, "conditioning equipment" may refer to components of the HVAC system configured to enable conditioning of the fluid to be provided to the conditioned space, such as heat exchangers (e.g., evaporator, condenser, furnace, etc.) configured to exchange thermal energy with the fluid, filters configured to remove particles from the fluid, louvers configured to regulate an amount of the fluid directed through the HVAC system, elements (e.g., pads or sheets) configured to adjust a humidity of the fluid, and so forth.

Generally, the vapor compression system and related components (e.g., conditioning equipment, such as filters) may be disposed within one or more housings of the HVAC system. For example, in some embodiments, the HVAC system may be an outdoor unit (e.g., a rooftop unit, a single packaged unit) having a housing in which the conditioning equipment is disposed. However, in other embodiments, the HVAC system may be a split system having multiple, separate housings with associated components of the vapor compression system and/or conditioning equipment disposed therein. The housing may include a frame (e.g., a support structure) and one or more panels (e.g., wall panels) coupled to the frame, and the conditioning equipment may be disposed within an internal volume defined by the frame and wall panels. The housing may include one or more inlets and/or outlets configured to receive and/or discharge, respectively, an air flow utilized or conditioned by the HVAC system to produce conditioned air. The housing (e.g., wall panels) may direct the air flow through the HVAC system and across or through one or more components of the conditioning equipment, for example, to condition the air flow. Unfortunately, existing HVAC system housings may have panels, such as single wall panels, that form spaces or voids between the panels and conditioning equipment within the HVAC system across which the air flow is to be directed. Instead of flowing across the conditioning equipment, the air flow may flow through the spaces or voids, thereby bypassing the conditioning equipment. Thus, at least a portion of the air flow may not be conditioned (e.g., heated, cooled, dehumidified, filtered, etc.) as desired.

Accordingly, embodiments of the present disclosure are directed to a wall panel assembly for an HVAC system housing that is configured to engage with a component (e.g., conditioning equipment) disposed within the housing of the HVAC system to reduce, mitigate, avoid, and/or block formation of a space or void therebetween. Thus, the wall panel assembly disclosed herein mitigates bypass of air flow around the conditioning equipment, thereby enabling proper and/or desired operation of the HVAC system. For example, as discussed in detail below, the wall panel assembly may have a panel (e.g., single wall panel) and a plurality of stiffeners coupled thereto. The stiffeners may be configured to increase a structural rigidity of the wall panel assembly. A stiffener of the plurality of stiffeners may also include a liner portion configured to engage (e.g., sealingly engage) with the component disposed within the housing. In this way, a space or void between the wall panel assembly and the component is not formed, and all or substantially all air flow may be directed across the component (e.g., without bypassing the component). Additionally, the wall panel assembly having the panel and plurality of stiffeners described herein may not include a double wall construction (e.g., full double wall construction). Thus, present embodiments enable a reduction in air flow bypass within the housing while also avoiding an increase in costs associated with manufacture of HVAC systems. That is, the wall panel assembly disclosed herein provides a more cost-effective alternative to double wall panels utilized in conventional systems.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a flash gas bypass system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
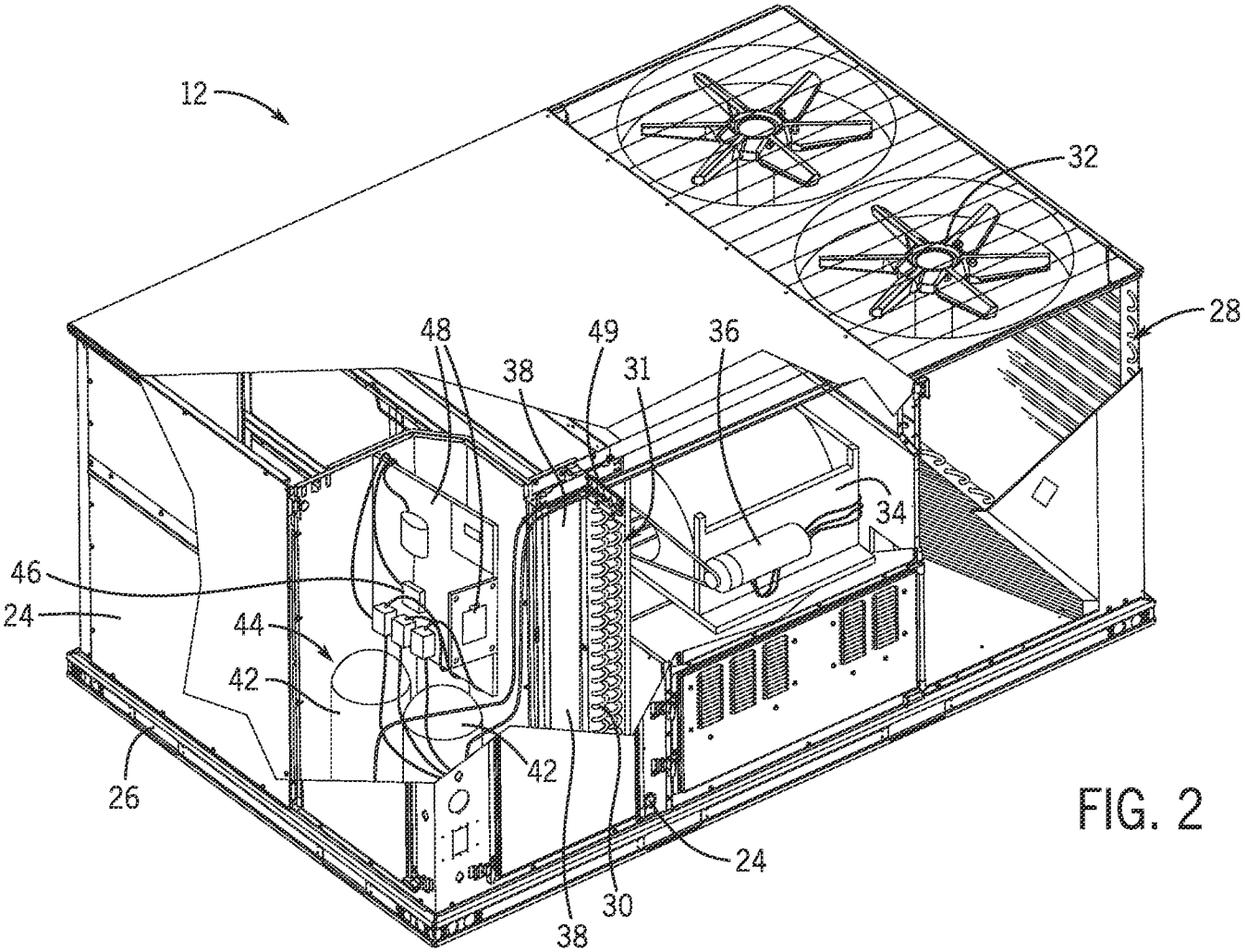
FIG. 2 is a perspective view of an embodiment of a packaged HVAC unit, in accordance with an aspect of the present disclosure.

FIG. 2 is a perspective view of an embodiment of the HVAC unit 12 that includes a flash gas bypass system in accordance with present embodiments. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
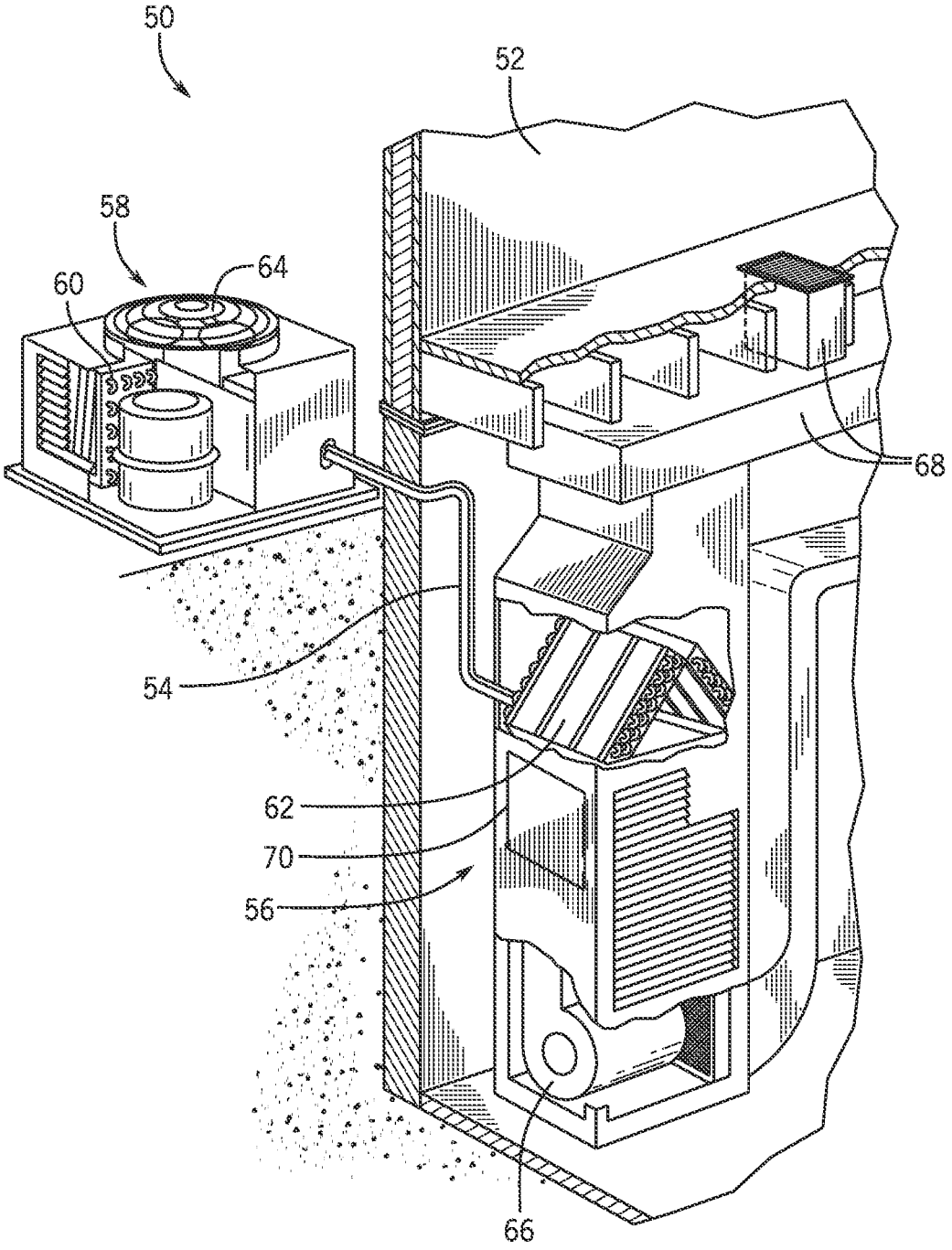
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The indoor unit 56 and/or the outdoor unit 58 includes a flash gas bypass system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
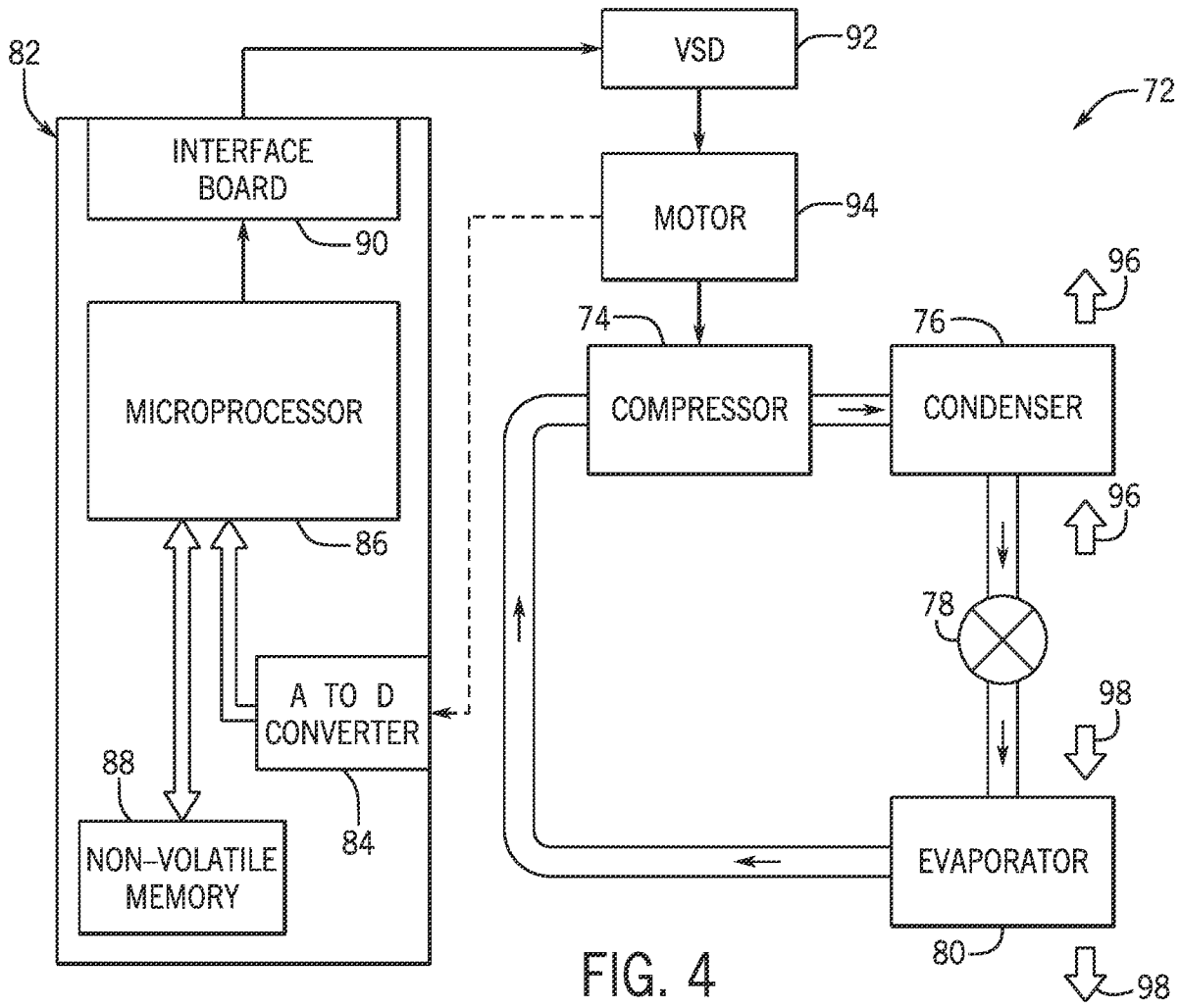
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80. In the illustrated embodiment, a flash gas bypass configuration in accordance with present embodiments is provided (as represented by the expansion device 78) such that liquid refrigerant is delivered to the evaporator without any substantial amount of vapor refrigerant.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52. In certain embodiments, the vapor compression system 72 may include a flash gas bypass system as disclosed herein. In the illustrated embodiment of FIG. 4, the flash gas bypass system is represented as part of the expansion device 78.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to a wall panel assembly for a housing of an HVAC system. The wall panel assembly is configured to engage with a component disposed within the housing, such as a component of conditioning equipment, to block bypass of air flow around the component. In particular, the wall panel assembly includes a panel (e.g., a single wall panel) and a plurality of stiffeners (e.g., reinforcing elements) coupled to the panel. Instead of including multiple wall panels with the wall panel assembly, a stiffener of the plurality of stiffeners also includes a liner portion that is configured to engage with the component within the housing. Thus, present embodiments enable a reduction in air flow bypass within the housing while also overcoming drawbacks (e.g., increased costs) associated with conventional systems.

Figure 5:
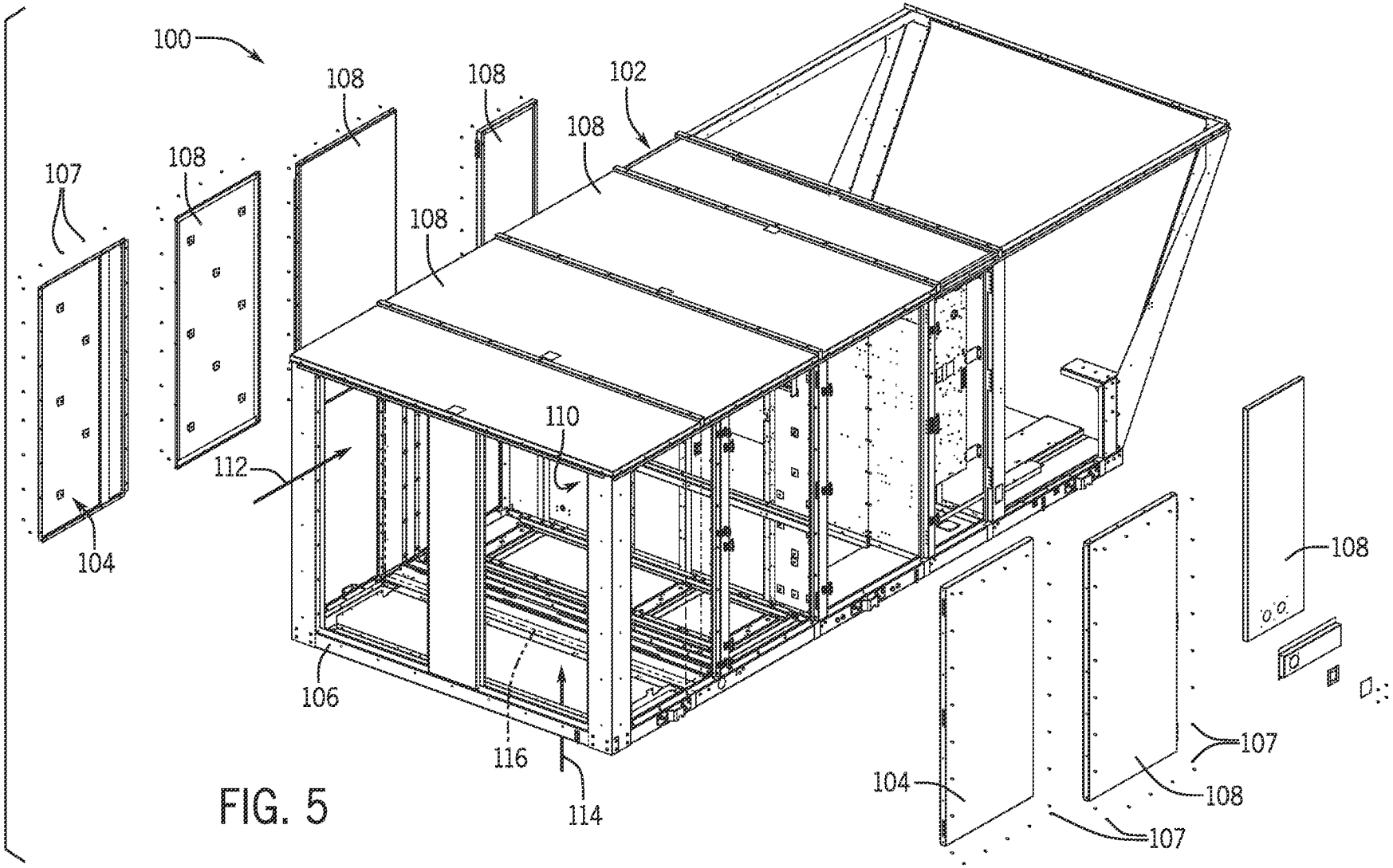
FIG. 5 is a partially exploded perspective view of an embodiment of an HVAC unit that includes a wall panel assembly having a liner portion configured to engage with an internal component of the HVAC unit, in accordance with an aspect of the present disclosure.

To provide context for the following discussion, FIG. 5 is a perspective view of an embodiment of an HVAC system 100 having a housing 102 with wall panel assemblies 104 (e.g., single wall panel assemblies, partial double wall panel assemblies) in accordance with the present techniques. The HVAC system 100 may be configured to direct a flow of conditioned air (e.g., heated air, cooled air, dehumidified air) to a thermal load, such as a space within a building, residential home, or other suitable structure. It should be appreciated that the HVAC system 100 illustrated in FIG. 5 is simplified and intended to focus on the housing 102 having the wall panel assemblies 104. However, the HVAC system 100 may also include embodiments and/or components of the HVAC unit 12 shown in FIGS. 1 and 2, embodiments and/or components of the split residential heating and cooling system 50 shown in FIG. 3, a rooftop unit (RTU), or any other suitable air handling unit or HVAC system.

The housing 102 of the HVAC system 100 may include a frame 106 (e.g., a housing frame, support structure, etc.) to which the wall panel assemblies 104 are coupled (e.g., secured, mounted, attached, etc.). For example, the frame 106 may be formed from rails (e.g., rails 26), bars, beams, etc. coupled to one another to define a support structure of the HVAC system 100. The housing 102 may also include additional panels 108 (e.g., wall panels, roof panels, access panels, base panels, etc.). The additional panels 108 may have a configuration (e.g., components, assemblies, etc.) similar to that of the wall panel assemblies 104 discussed in detail herein, or the additional panels 108 may have different configurations. The wall panel assemblies 104 and the additional panels 108 may be coupled to the frame 106 (e.g., via mechanical fasteners 107) to define an interior volume 110 of the housing 102. Conditioning equipment, such as the heat exchanger 30, filters 38, components of the vapor compression system 72, and/or other components configured to adjust a quality and/or quantity of an air flow directed through the housing 102, may be disposed within the interior volume 110. The housing 102 is configured to receive one or more air flows and direct the one or more air flows through and/or across the conditioning equipment in order to produce a supply air flow that is discharged toward a conditioned space. For example, the housing 102 may be configured to receive an outdoor air flow, as indicated by arrow 112, from an ambient environment surrounding the HVAC system 100 and/or a return air flow, as indicated by arrow 114, from the conditioned space. The air flow(s) is directed through the housing 102 and across and/or through the conditioning equipment to produce the supply air flow that is discharged from the HVAC system 100 and supplied to the conditioned space.

In order to enable improved flow of the air flow through the housing 102, the housing 102 includes the wall panel assemblies 104 of the present disclosure. As described in detail below, the wall panel assemblies 104 are configured to block bypass of the air flow around the conditioning equipment within the housing 102. To this end, the wall panel assemblies 104 are configured to engage with (e.g., abut) a component 116 (e.g., internal component) within the housing 102. For example, the component 116 may be a component of the conditioning equipment (e.g., a heat exchanger, such as heat exchanger 30) or a structural component associated with the conditioning equipment. In some embodiments, the component 116 may be a rack or frame (e.g., support structure) configured to support a heat exchanger, such as the evaporator 80, and/or a filter (e.g., filter 38) of the HVAC system 100. The wall panel assembly 104 engages (e.g., sealingly engages) with the component 116 to block formation of a space or void between the wall panel assembly 104 and the component 116 through which the air flow may otherwise flow and bypass the component 116 (e.g., conditioning equipment) within the housing 102. For example, as shown in the illustrated embodiment, the housing 102 may include two wall panel assemblies 104 positioned on opposite sides of the housing 102 relative to the component 116, and each wall panel assembly 104 may be configured to engage (e.g., sealingly engage) with the component 116 in the manner described in detail below. Thus, the wall panel assemblies 104 enable flow of the air flow (e.g., all or substantially all of the air flow) across the component 116, as desired, instead of flowing around and/or bypassing the component 116.

Figure 6:
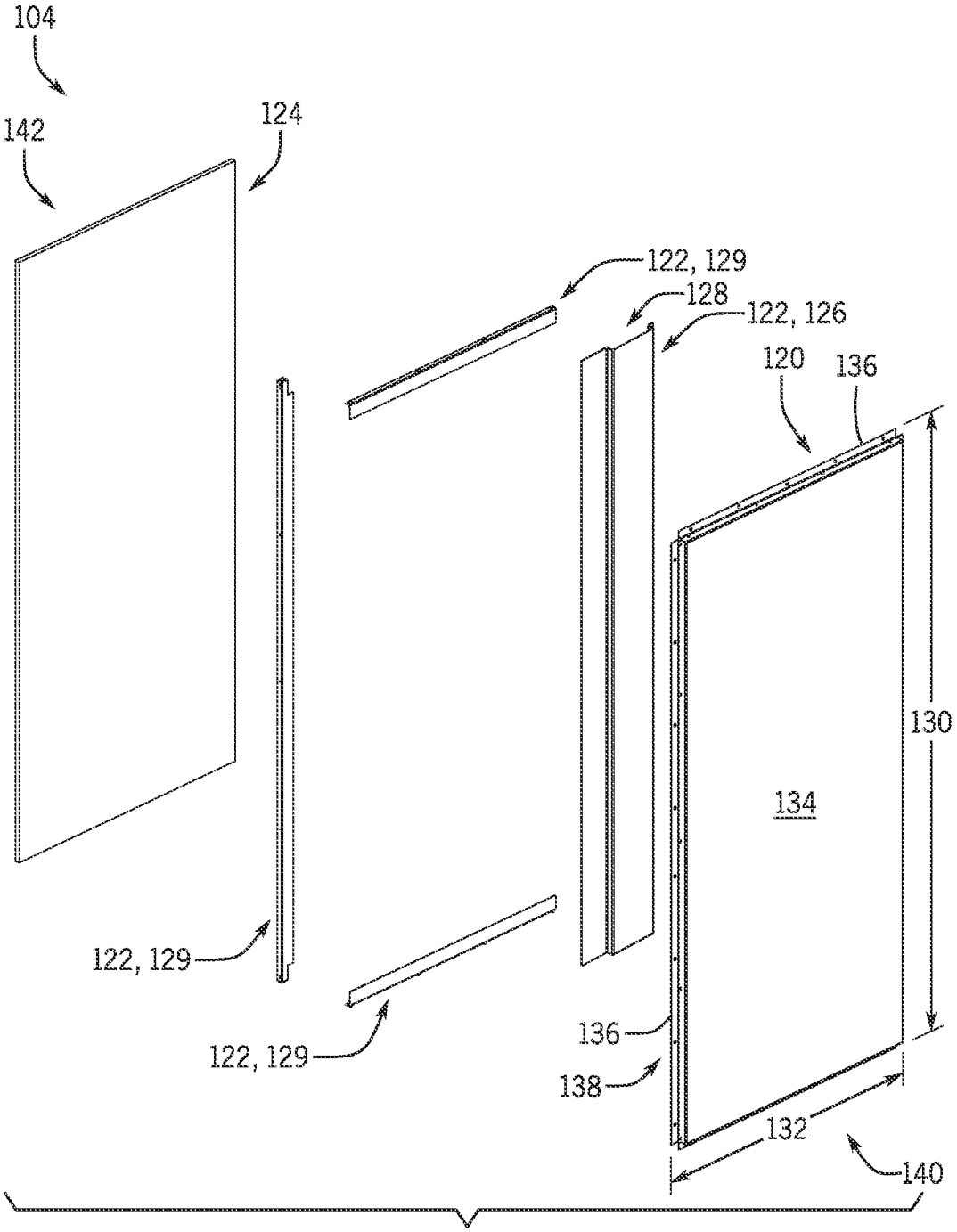
FIG. 6 is an exploded perspective view of an embodiment of a wall panel assembly of an HVAC unit, in accordance with an aspect of the present disclosure.

FIG. 6 is an exploded perspective view of an embodiment of the wall panel assembly 104, illustrating various components configured to be assembled together to form the wall panel assembly 104. In particular, the wall panel assembly 104 includes a panel 120, a plurality of stiffeners 122, and an insulation layer 124. As described in further detail below with reference to FIGS. 7 and 8, one or more of the stiffeners 122 (e.g., an extended stiffener 126, elongated stiffener, sealing stiffener, retainers, etc.) is modified (e.g., relative to other stiffeners 122) in accordance with the present techniques to enable engagement (e.g., airtight engagement) with the component 116 disposed within the housing 102. For example, the extended stiffener 126 includes a profile or geometry (e.g., a stepped profile, a C-channel geometry, etc.) that defines a liner portion 128 configured to abut against the component 116 to mitigate formation of a space or void between the wall panel assembly 104 and the component 116 and thus block air flow therebetween. In some embodiments, remaining stiffeners 129 of the plurality of stiffeners 122 may not include the liner portion 128 of the extended stiffener 126.

As shown, the panel 120 (e.g., wall panel) of the wall panel assembly 104 includes a sheet, plate, or other generally flat component that generally defines an overall height 130 and width 132 of the wall panel assembly 104. The panel 120 may be a single panel (e.g., single piece) extending the height 130 and width 132 and may be formed from any suitable material, such as sheet metal. The panel 120 includes a main body 134 (e.g., single layer main body) and flanges 136 extending from the main body 134 about and/or along a perimeter 138 of the main body 134 (e.g., panel 120). For example, the panel 120 may be formed from a single piece of sheet metal with the flanges 136 formed via cutting, bending, and/or another suitable manufacturing process. In an assembled configuration, the insulation layer 124 may be secured to the main body 134 of the panel 120. For example, the insulation layer 124 may be formed from foam, rubber, foil, another suitable material, or any combination thereof. In some embodiments, the insulation layer 124 may be attached to the main body 134 via an adhesive.

The plurality of stiffeners 122 is also configured to be secured to the panel 120. As will be appreciated, each stiffener 122 may be a rail, bar, or other strip of material (e.g., sheet metal) configured to reinforce the panel 120 and increase a structural rigidity (e.g., stiffness) of the wall panel assembly 104. Additionally or alternatively, the plurality of stiffeners 122 may be retainers configured to secure the insulation layer 124 in place against the main body 134 of the panel 120. For example, the plurality of stiffeners 122 may be attached or mounted to the flanges 136 extending from the main body 134, such as via mechanical fasteners, such that each stiffener 122 is attached to the panel 120 on a respective edge or side of the panel 120 and/or main body 134. Thus, the plurality of stiffeners 122 extends (e.g., cooperatively extends) generally along the perimeter 138 of the main body 134 (e.g., of the panel 120). For example, the plurality of stiffeners 122 may include two horizontally oriented stiffeners 122 extending between two vertically oriented stiffeners 122. In some embodiments, the components of the wall panel assembly 104 may be assembled such that the insulation layer 124 is captured (e.g., at least partially captured) between the panel 120 and the plurality of stiffeners 122. In this way, the plurality of stiffeners 122 may secure the insulation layer 124 to the panel 120 (e.g., in addition to, or instead of, an adhesive disposed between the insulation layer 124 and the main body 134 of the panel 120). However, it should be noted that some embodiments of the wall panel assembly 104 may not include the insulation layer 124. Thus, the plurality of stiffeners 122 may be secured to the panel 120 to increase the structural rigidity of the wall panel assembly 104 without the insulation layer 124 therebetween.

In an assembled configuration, the wall panel assembly 104 has an external facing side 140 and an internal facing side 142. When installed with the housing 102, the external facing side 140 of the wall panel assembly 104 (e.g., the main body 134 of the panel 120) is exposed to an environment surrounding the HVAC system 100, and the internal facing side 142 is exposed to the interior volume 110 of the housing 102. Specifically, the main body 134 of the panel 120 on the exterior facing side 140 may be exposed to the environment surrounding the HVAC system 100. On the interior facing side 142, the insulation layer 124 and the plurality of stiffeners 122 may be exposed to the interior volume 110 within the housing 102. Thus, in the manner described below, the liner portion 128 of the extended stiffener 126 may abut the component 116 within the interior volume 110 to create a sealing engagement and/or sealing interface therebetween and enable improved direction of air flow across conditioning equipment within the housing 102.

Figure 7:
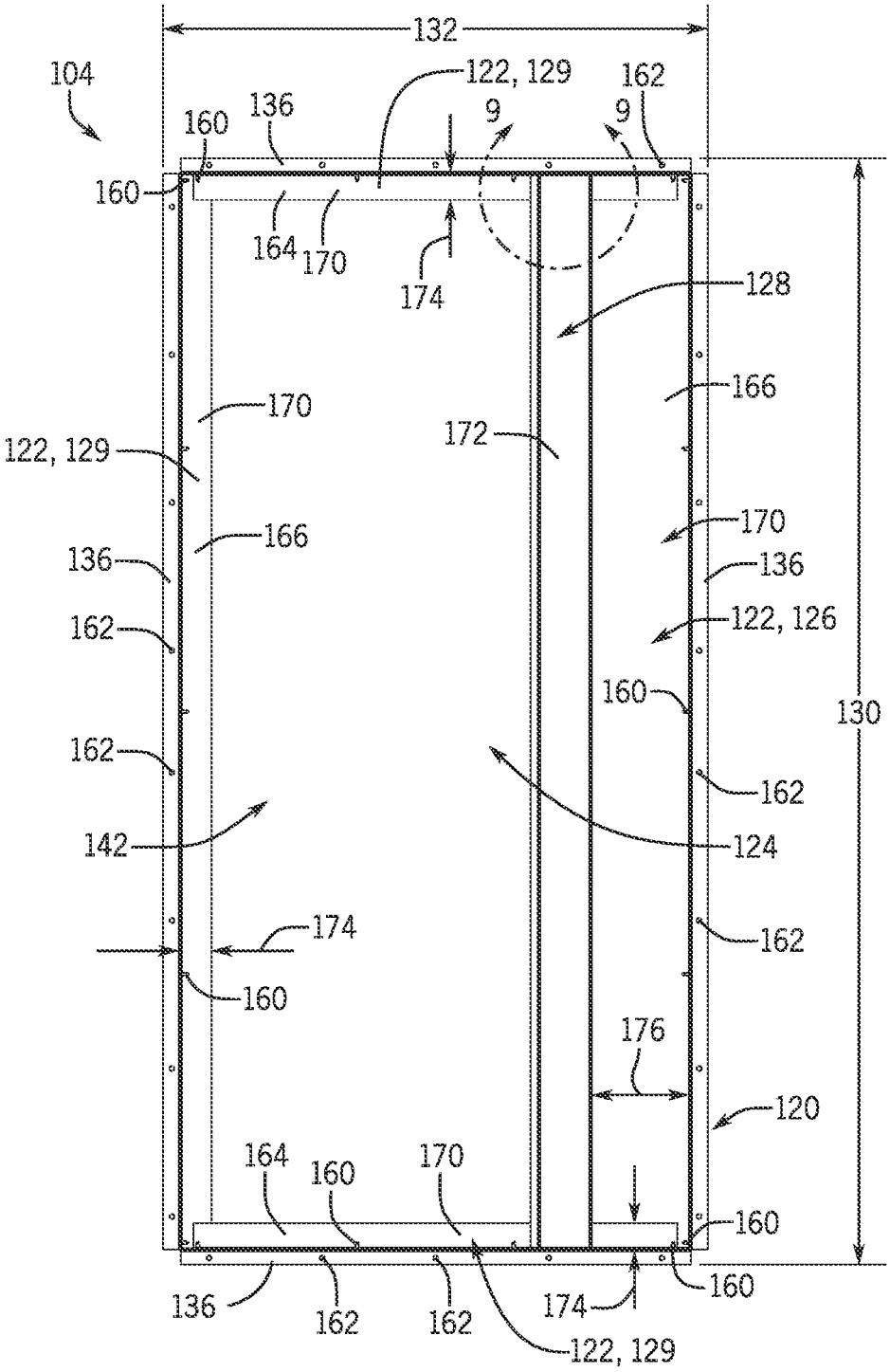
FIG. 7 is a side view of an embodiment of a wall panel assembly of an HVAC unit, in accordance with an aspect of the present disclosure.

FIG. 7 is a side view of an embodiment of the wall panel assembly 104 in an assembled configuration, illustrating the interior facing side 142 of the wall panel assembly 104. As described above, the plurality of stiffeners 122 is secured to the flanges 136 of the panel 120 along the perimeter 138 of the main body 134 and/or the panel 120. Additionally, the plurality of stiffeners 122 captures (e.g., at least partially captures) the insulation layer 124 between the plurality of stiffeners 122 and the panel 120. The plurality of stiffeners 122 may be secured to the flanges 126 via mechanical fasteners 160 (e.g., screws, rivets, nuts and bolts, etc.) or via another suitable securement technique. For example, each stiffener 122 may include holes (e.g., apertures, mounting holes) formed therein and configured to align with corresponding holes (e.g., apertures, mounting holes) formed in the flanges 136. The mechanical fasteners 160 may extend through aligned holes of the stiffeners 122 and flanges 136 to secure the stiffeners 122 to the flanges 126. The flanges 136 also include holes 162 (e.g., apertures, mounting holes) formed therein that are configured to align with corresponding holes (e.g., apertures, mounting holes) formed in the frame 106 of the housing 102 to enable mounting of the wall panel assembly 104 to the frame 106 (e.g., via mechanical fasteners, such as screws).

As shown in the illustrated embodiment, the plurality of stiffeners 122 secured to the panel 120 may at least partially overlap with one another in an assembled configuration of the wall panel assembly 104. For example, horizontal stiffeners 164 (e.g., horizontally-oriented stiffeners, first stiffeners) of the plurality of stiffeners 122 may at least partially overlap with vertical stiffeners 166 (e.g., vertically-oriented stiffeners, second stiffeners) of the plurality of stiffeners 122. In this way, a structural rigidity and/or stiffness of the wall panel assembly 104 may be reinforced and/or improved. Similarly, retention of the insulation layer 124 between the main body 134 of the panel 120 and the plurality of stiffeners 122 may be improved. The overlapping arrangement of the stiffeners 122 is described in further detail below with reference to FIGS. 9 and 10.

As mentioned above, the plurality of stiffeners 122 includes the extended stiffener 126 (e.g., vertical stiffener 166) having the liner portion 128 configured to abut and/or engage with the component 116 disposed within the interior volume 110 of the housing 102. In the illustrated embodiment, each stiffener 122 includes a flat portion 170 (e.g., a flat surface) extending from the corresponding flange 136 to which the stiffener 122 is secured. In other words, the flat portion 170 extends generally inwardly from the perimeter 138 of the main body 134. The flat portion 170 of each stiffener 122 is configured to abut against and/or extend along the insulation layer 124 secured against the main body 134 of the panel 120 and/or against the main body 134 to provide increased rigidity of the wall panel assembly 104. The extended stiffener 126 also includes a raised portion 172 (e.g., a raised surface) extending from the flat portion 170 of the extended stiffener 126. As described in further detail below with reference to FIG. 8, the raised portion 172 of the extended stiffener 126 may define the liner portion 128 of the extended stiffener 126 configured to engage (e.g., abut) the component 116 within the housing 102. To this end, the raised portion 172 of the extended stiffener 126 may be offset from the flat portion 170 of the extended stiffener 126 and/or offset from the insulation layer 124 or main body 134 in the assembled configuration of the wall panel assembly 104.

Further, the flat portion 170 of each remaining stiffener 129 extends from the corresponding flange 136 (e.g., extends inwardly from the perimeter 138 of the main body 134) by a dimension 174 (e.g., a width, a depth). The dimensions 174 of the flat portions 170 of the remaining stiffeners 129 may be the same or different from one another. A magnitude of the dimensions 174 of the flat portions 170 of the remaining stiffeners 129 may be selected based on a desired structural rigidity of the wall panel assembly 104, a cost associated with manufacturing the wall panel assembly 104, another suitable factor, or any combination thereof. As shown, the flat portions 170 of the remaining stiffeners 129 extend (e.g., extend inwardly) along a portion of the height 130 and/or the width 132 of the wall panel assembly 104 (e.g., by the dimension 174), such that a portion of the insulating layer 124 is exposed (e.g., to the interior volume 110) on the interior facing side 142 of the wall panel assembly 104 in the assembled and/or installed configuration.

The flat portion 170 of the extended stiffener 126 also includes a dimension 176 (e.g., a width, a depth) along which the flat portion 170 of the extended stiffener 126 extends from the corresponding flange 136 to which the extended stiffener 126 is secured. As shown, the dimension 176 of the flat portion 170 of the extended stiffener 126 may be greater than the respective dimensions 174 of the flat portions 170 of the remaining stiffeners 129. As will be appreciated, a magnitude of the dimension 176 may be selected based on a desired position or location of the raised portion 172 of the extended stiffener 126 in an installed configuration of the wall panel assembly 104 with the housing 102. For example, the magnitude of the dimension 176 may be selected such that the raised portion 172 of the extended stiffener 126 is aligned with and/or abuts the component 116 within the housing 102 in the installed configuration of the wall panel assembly 104 with the housing 102. It should be noted that, similar to flat portions 170 of the remaining stiffeners 129, the flat portion 170 and the raised portion 172 of the extended stiffener 126 extend along a portion of the width 132 of the wall panel assembly 104 instead of extending along an entirety of the width 132. In this way, the wall panel assembly 104 including the features described herein enables improved direction of air flow within the housing 102 (e.g., via sealing engagement between the wall panel assembly 104 and the component 116) at reduced manufacturing costs compared to conventional double wall panels. That is, present embodiments of the wall panel assembly 104 do not include a full double wall construction (e.g., two wall panels extending an entirety of the height 130 and width 132) and may therefore be manufactured more cost effectively than traditional wall panels having a double wall configuration.

Figure 8:
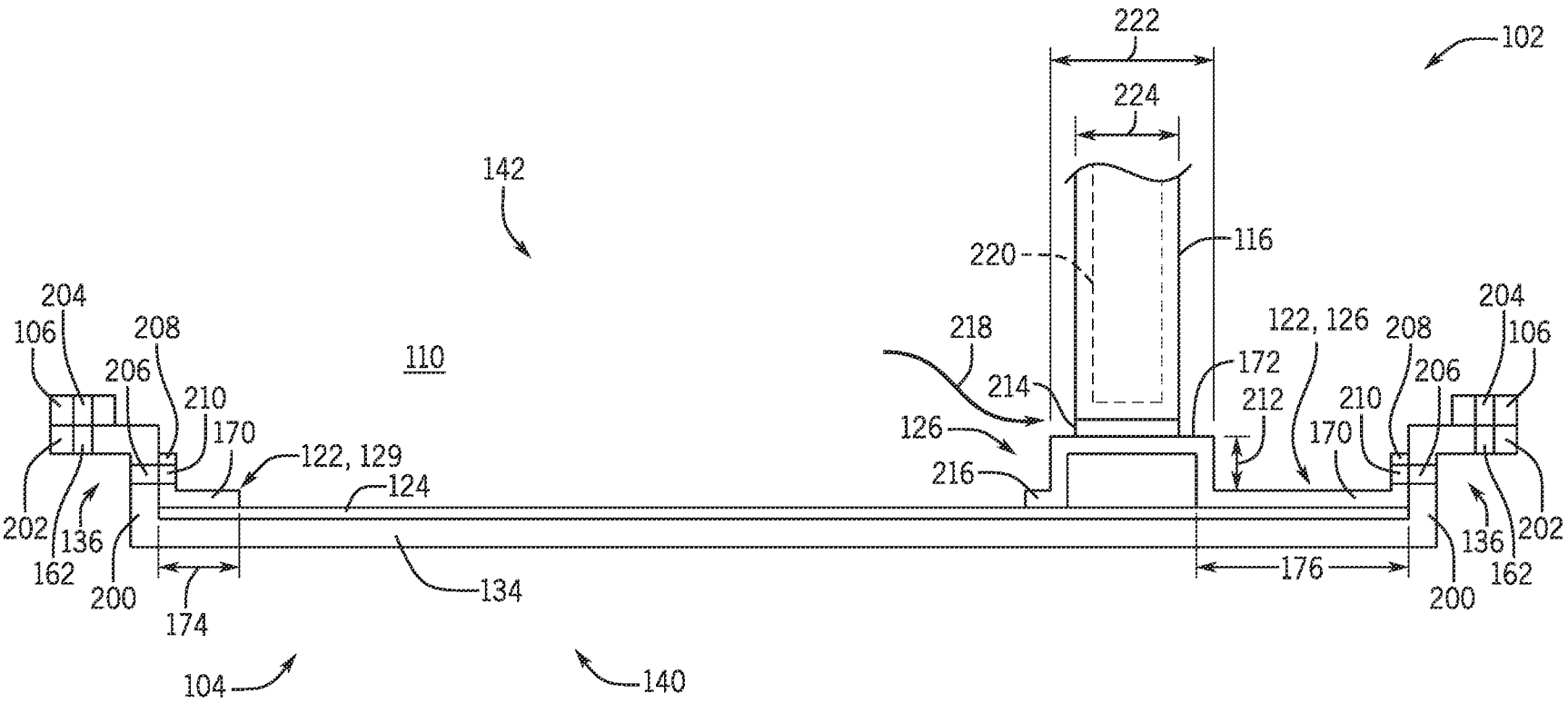
FIG. 8 is a schematic of an embodiment of a portion of an HVAC unit, illustrating a wall panel assembly having a liner portion engaged with an internal component of the HVAC unit, in accordance with an aspect of the present disclosure.

FIG. 8 is a schematic of an embodiment of the wall panel assembly 104 installed with the housing 102 of the HVAC system 100, illustrating engagement between the wall panel assembly 104 and the component 116 disposed within the interior volume 110 of the housing 102. For example, the component 116 may be a component of the conditioning equipment, a rack or other structural support configured to support a heat exchanger (e.g., evaporator 80), support a filter (e.g., filter 38) of the HVAC system 100, a component of the conditioning equipment, and/or other component of the HVAC system 100 across which an air flow is to be directed.

As described above, the wall panel assembly 104 may be coupled to the frame 106 (e.g., rails 26, base rails, vertical rails, top rails, bottom rails, etc.) of the housing 102 via the flanges 136 of the panel 120. The plurality of stiffeners 122 is also secured to the panel 120 via the flanges 136. Specifically, each flange 136 includes a crosswise extension 200 (e.g., a first portion) extending (e.g., extending crosswise) from the main body 134 and a lateral extension 202 (e.g., a second portion) extending (e.g., extending crosswise) from the crosswise extension 200. The lateral extension 202 may extend generally parallel (e.g., within one, two, three, four, or five degrees) with the main body 134 of the panel 120 and includes the holes 162 configured to receive mechanical fasteners therethrough to secure the wall panel assembly 104 to the frame 106 (e.g., via holes 204 formed in the frame 106). The crosswise extension 200 of each flange 136 may also include holes 206 (e.g., apertures, mounting holes, slots) formed therein to enable mounting of the stiffeners 122 to the panel 120. Specifically, each stiffener 122 may include a mounting portion 208 (e.g., mounting flange) extending from the respective flat portion 170 of the stiffener 122 and including holes 210 (e.g., apertures, mounting holes, slots). The holes 210 of the mounting portion 208 may align with the holes 206 formed in the crosswise extension 200 of the flange 136 to which the stiffener 122 is secured, and fasteners (e.g., mechanical fasteners 160) may extend through the holes 206, 210 to secure the stiffener 122 to the panel 120. In this way, the wall panel assembly 104 may be assembled without formation of holes, apertures, or other openings in the main body 134 of the panel 120, which may reduce ingress and/or egress of fluid (e.g., air, moisture, etc.) into or out of the housing 102 via the wall panel assembly 104. However, in some embodiments, certain stiffeners 122 and/or flanges 136 of the wall panel assembly 104 may not include the holes 206 and/or 210, and the stiffeners 122 may be secured to the panel 120 in the manner described below with reference to FIGS. 9 and 10 or in another suitable manner.

The embodiment of FIG. 8 also illustrates engagement between the extended stiffener 126 and the component 116 within the housing 102. As mentioned above, the component 116 may be a heat exchanger rack, a filter rack, or another rack or support structure configured to support conditioning equipment (e.g., filters 38 and/or evaporator 80) of the HVAC system 100. The extended stiffener 126 includes the liner portion 128 generally defined by the raised portion 172 of the extended stiffener 126. The liner portion 128 and/or the raised portion 172 extending from the flat portion 170 may have a generally C-channel and/or C-shaped geometry, as shown. As mentioned above, the raised portion 172 (e.g., raised surface, elevated surface) is offset from the flat portion 170 of the extended stiffener 126 (e.g., in a direction perpendicular or crosswise to the width 132 of the wall panel assembly 104), such that the raised portion 172 is raised and/or elevated from the insulation layer 124 and/or main body 134 of the panel 120. An offset dimension 212 of the raised portion 172 may be selected based on an arrangement of the component 116 within the housing 102 (e.g., relative to the wall panel assembly 104) to enable abutment (e.g., sealing engagement) between the extended stiffener 126 (e.g., raised portion 172) and the component 116 in the installed configuration. Thus, when installed with the housing 102 and the HVAC system 100, the raised portion 172 (e.g., C-channel) may engage (e.g., sealingly engage) with the component 116 disposed within the interior volume 110 of the housing 102 (e.g., to block air flow therebetween).

In some embodiments, the extended stiffener 126 and/or the HVAC system 100 may include additional features to enable desired abutment and/or engagement between the extended stiffener 126 and the component 116. For example, in the illustrated embodiment, as gasket 214 is positioned between the component 116 and the raised portion 172 of the extended stiffener 126. The gasket 214 may be formed from foam, rubber, or other suitable material (e.g., compressible material, resilient material) and may be attached to the component 116 (e.g., via adhesive). In other embodiments, the gasket 214 may be secured to the raised portion 172 of the extended stiffener 126. When installed, the raised portion 172 may be biased and/or positioned against the gasket 214 to create a sealing engagement (e.g., airtight seal) between the extended stiffener 126 and the component 116. In the illustrated embodiment, the extended stiffener 126 also includes a lateral extension 216 (e.g., of and/or extending from the liner portion 128). The lateral extension 216 may be generally aligned with the flat portion 170 of the extended stiffener 126 and is configured to abut against the insulation layer 124 in the assembled configuration of the wall panel assembly 104. The lateral extension 216 may enable proper alignment of the raised portion 172 and/or engagement between the raised portion 172 and the component 116 (e.g., gasket 214) in the installed configuration of the wall panel assembly 104 with the housing 102 and the HVAC system 100. Further, in some embodiments, a dimension 222 (e.g., a width) of the raised portion 172 may be greater than a dimension 224 (e.g., a width) of the component 116. As a result, the liner portion 128 may provide an installation tolerance for the wall panel assembly 104 while providing a desired sealing engagement between the wall panel assembly 104 and the component 116.

As discussed above, the features of the extended stiffener 126 described herein are configured to enable desired direction of air flow through the housing 102 of the HVAC system 100. In particular, the extended stiffener 126 is configured to engage with the component 116 disposed within the housing 102 to block bypass of air flow around the component 116 (e.g., between the wall panel assembly 104 and the component 116, represented by arrow 218). For example, the component 116 may be a filter rack configured to support one or more filters 220 of the HVAC system 100. Abutment between the raised portion 172 of the extended stiffener 126 and the component 116 may therefore promote flow of the air flow through and/or across the filters 220 instead of around the filters 220 (e.g., bypassing the filters 220). In this way, all or substantially all of the air flow may flow through the filters 220. Additionally, abutment between the raised portion 172 of the extended stiffener 126 and the component 116 (e.g., filter rack) may promote proper alignment of the filters 220 within the filter rack (e.g., component 116). As noted above, the component 116 may be another element of the HVAC system 100, such as a heat exchanger rack configured to support a heat exchanger, and the extended stiffener 126 may engage with the component 116 to block bypass of air between the component 116 and the wall panel assembly 104.

Figure 9:
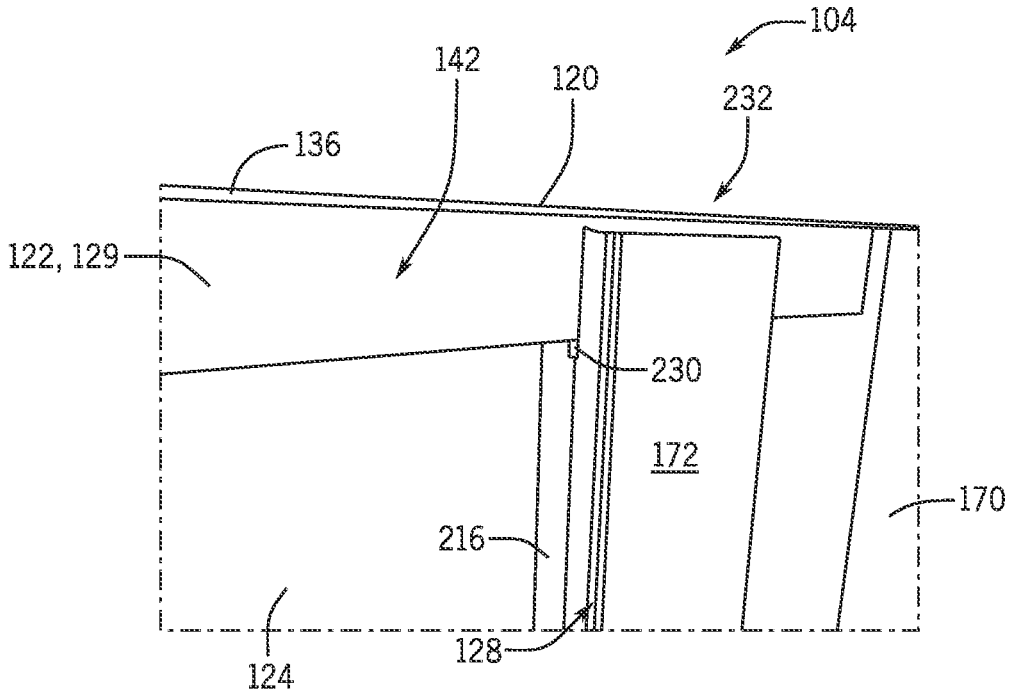
FIG. 9 is a perspective view of an embodiment of a portion of a wall panel assembly, illustrating an assembled configuration of the wall panel assembly, in accordance with an aspect of the present disclosure.
Figure 10:
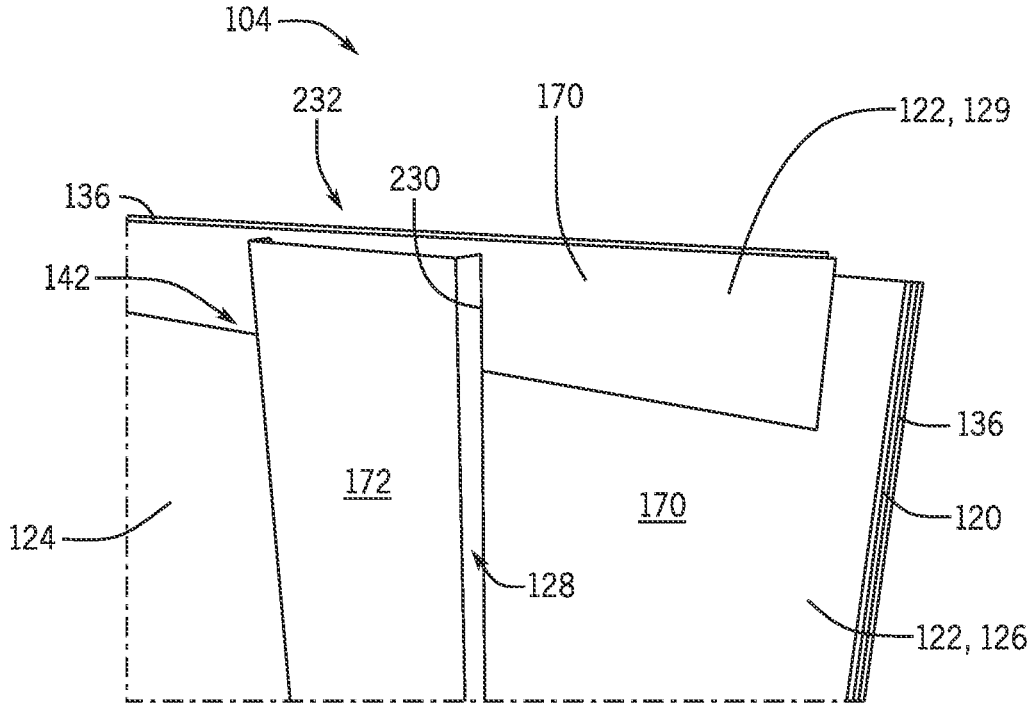
FIG. 10 is a perspective view of an embodiment of a portion of a wall panel assembly, illustrating an assembled configuration of the wall panel assembly, in accordance with an aspect of the present disclosure.

FIGS. 9 and 10 are partial perspective views of an embodiment of the wall panel assembly 104, illustrating an arrangement of stiffeners 122 secured to the panel 120 on the interior facing side 142 of the wall panel assembly 104. As mentioned above, the plurality of stiffeners 122 extends along the perimeter 138 (e.g., outer boundary) of the main body 134 of the panel 120 and may at least partially overlap with one another in an assembled configuration of the wall panel assembly 104. To enable overlap of remaining stiffeners 129 (e.g., horizontally oriented stiffeners 122, 164) with the extended stiffener 126 having the liner portion 128 (e.g., raised portion 172), the extended stiffener 126 may include one or more slots 230 (e.g., slits) formed therein. Specifically, as shown in FIGS. 9 and 10, slots 230 may be formed between the flat portion 170 and the liner portion 128 (e.g., raised portion 172) and/or between the liner portion 128 (e.g., raised portion 172) and the lateral extension 216 of the extended stiffener 126. In particular, the slots 230 may be formed at an end 232 of the extended stiffener 126 and may be sized (e.g., dimensioned) to accommodate one of the remaining stiffeners 129. Similar slots 230 may be formed in an end of the extended stiffener 126 opposite the end 232 for receiving another remaining stiffener 129 (e.g., horizontally oriented stiffener 122, 164) coupled to the panel 120.

A dimension (e.g., height or length) of the slots 230 along the extended stiffener 126 may correspond to the dimension 174 of the flat portion 170 of the remaining stiffener 129 positioned adjacent to the extended stiffener 126. Thus, in the assembled configuration, the slots 230 may receive the flat portion 170 of the remaining stiffener 129 to which the extended stiffener 126 is adjacent, such that the remaining stiffener 129 captures the lateral extension 216 and/or the flat portion 170 of the extended stiffener 126 against the insulation layer 124 and/or the main body 134 of the panel 120. Therefore, the remaining stiffener 129 may secure the extended stiffener 126 to the panel 120 in the assembled configuration illustrated (e.g., without mechanical fasteners extending through holes 208, 210 associated with the extended stiffener 126). However, the liner portion 128 (e.g., the raised portion 172) may be disposed outward from the remaining stiffener 129 (e.g., relative to the main body 134 of the panel 120), such that the raised portion 172 may engage with the component 116 (e.g., the gasket 214) within the housing 102 in the installed configuration of the wall panel assembly 104. In this way, the plurality of stiffeners 122 including the extended stiffener 126 may be assembled with one another to capture the insulation layer 124 against the panel 120 and provide the raised portion 172 configured to engage with the component 116.

As set forth above, embodiments of the present disclosure may provide one or more technical effects useful for directing air flow through a housing of an HVAC system, such as by blocking bypass of air flow around a component (e.g., a filter, a heat exchanger, etc.) disposed within the housing. In particular, embodiments of the present disclosure are directed to a wall panel assembly configured to engage with a component (e.g., conditioning equipment, a support structure of conditioning equipment) disposed within the housing of the HVAC system to reduce, mitigate, avoid, and/or block formation of a space or void therebetween through which air may otherwise flow. Thus, the wall panel assembly disclosed herein mitigates bypass of air flow around the conditioning equipment, thereby enabling proper and/or desired operation of the HVAC system. For example, the wall panel assembly may have a panel (e.g., single wall panel) and a plurality of stiffeners coupled thereto. The stiffeners may be configured to increase a structural rigidity of the wall panel assembly and/or retain an insulation layer of the wall panel assembly against the panel. A stiffener of the plurality of stiffeners may also include a liner portion configured to engage (e.g., sealingly engage) with the component disposed within the housing. In this way, a space or void between the wall panel assembly and the component is not formed, and all or substantially all air flow may be directed across the component (e.g., without bypassing the component through a space or void). Additionally, the wall panel assembly having the panel and plurality of stiffeners described herein may not include a double wall construction (e.g., full double wall construction). Thus, present embodiments enable a reduction in air flow bypass within the housing while also reducing costs associated with manufacture of HVAC systems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. § 112(f).

The invention claimed is:

1. A wall panel assembly for a heating, ventilation, and air conditioning (HVAC) unit, comprising:

a panel comprising a main body, wherein the panel is configured to be fastened to a frame of the HVAC unit; and a plurality of stiffeners attached to the panel along a perimeter of the main body, wherein a stiffener of the plurality of stiffeners comprises a flat portion and a raised portion offset from the flat portion, wherein the raised portion is configured to sealingly engage with a component disposed within the HVAC unit.

2. The wall panel assembly of claim 1, wherein the panel comprises a plurality of flanges extending from the main body along the perimeter of the main body, and each stiffener of the plurality of stiffeners is attached to a corresponding flange of the plurality of flanges.

3. The wall panel assembly of claim 2, wherein each flange comprises a first portion extending crosswise from the main body and a second portion extending crosswise from the first portion, each stiffener of the plurality of stiffeners is attached to the first portion of the corresponding flange of the plurality of flanges, and the second portion of each flange of the plurality of flanges is configured to be fastened to the frame of the HVAC unit.

4. The wall panel assembly of claim 1, comprising an insulation layer disposed against the main body of the panel.

5. The wall panel assembly of claim 4, wherein the insulation layer is secured to the main body of the panel via an adhesive.

6. The wall panel assembly of claim 4, wherein the insulation layer is at least partially captured between the main body of the panel and the plurality of stiffeners attached to the panel.

7. The wall panel assembly of claim 1, wherein the plurality of stiffeners at least partially overlaps with one another.

8. The wall panel assembly of claim 7, wherein the stiffener of the plurality of stiffeners comprises a slot formed therein between the flat portion and the raised portion, and wherein an additional stiffener of the plurality of stiffeners extends through the slot of the stiffener.

9. The wall panel assembly of claim 1, wherein the panel is formed from a single piece of sheet metal.

10. A heating, ventilation, and air conditioning (HVAC) unit, comprising:

a housing frame;

a support rack disposed within the housing frame, wherein the support rack is configured to support conditioning equipment of the HVAC unit; and a wall panel assembly coupled to the housing frame, wherein the wall panel assembly comprises:

a single wall panel comprising a main body; and a plurality of stiffeners coupled to the single wall panel and extending along a perimeter of the main body, wherein the plurality of stiffeners comprises an extended stiffener comprising a flat portion and a raised portion offset from the flat portion, and wherein the raised portion is configured to create a sealing interface with the support rack.

11. The HVAC unit of claim 10, wherein the support rack is a filter rack, and the conditioning equipment comprises at least one filter configured to filter an air flow directed through the HVAC unit.

12. The HVAC unit of claim 10, comprising a gasket attached to the support rack, wherein the raised portion abuts the gasket.

13. The HVAC unit of claim 10, wherein the wall panel assembly comprises an insulation layer, and the insulation layer is at least partially captured between the single wall panel and the plurality of stiffeners.

14. The HVAC unit of claim 13, wherein the insulation layer is at least partially exposed to an interior volume of the HVAC unit.

15. The HVAC unit of claim 13, wherein the plurality of stiffeners comprises additional stiffeners, the extended stiffener and the additional stiffeners cooperatively extend along the perimeter of the main body, each additional stiffener comprises a respective flat portion, and the flat portion of the extended stiffener and the respective flat portions of the additional stiffeners compress the insulation layer against the main body of the single wall panel.

16. The HVAC unit of claim 15, wherein the single wall panel comprises a plurality of flanges extending from the main body, each stiffener of plurality of stiffeners is attached to a corresponding flange of the plurality of flanges, the flat portion of the extended stiffener extends from the corresponding flange attached to the extended stiffener by a first dimension, the respective flat portion of each additional stiffener extends from the corresponding flange attached to the additional stiffener by a respective second dimension, and the first dimension is greater than the respective second dimensions.

17. A wall panel assembly of a heating, ventilation, and air conditioning (HVAC) unit housing, comprising:

a panel comprising a main body, wherein the panel is formed from a single sheet of material; and a plurality of stiffeners coupled to the panel at corresponding edges of the main body, wherein each stiffener of the plurality of stiffeners comprises a flat portion extending along the main body, and a stiffener of the plurality of stiffeners comprises a raised portion extending and offset from the flat portion of the stiffener, wherein the raised portion is configured to abut and sealingly engage with a component disposed within the HVAC unit housing.

18. The wall panel assembly of claim 17, comprising an insulation layer disposed against the main body of the panel, wherein the plurality of stiffeners secures the insulation layer against the main body of the panel, and the plurality of stiffeners at least partially overlaps with one another.

19. The wall panel assembly of claim 17, wherein the stiffener of the plurality of stiffeners comprises a slot formed therein between the flat portion and the raised portion of the stiffener, and an additional stiffener of the plurality of stiffeners extends through the slot.

20. The wall panel assembly of claim 17, wherein the component disposed within the HVAC unit housing comprises a rack configured to support a filter, an evaporator, or both disposed within the HVAC unit housing, and wherein the wall panel assembly is configured to be mounted to a lateral side of the HVAC unit housing.

* * * * *